US005983517A

United States Patent [19]

Ehlhardt

[11] Patent Number: 5,983,517

[45] Date of Patent: Nov. 16, 1999

[54] HAIR DRYING AND STYLING APPLIANCE

[75] Inventor: Huub Ehlhardt, Drachten, Netherlands

[73] Assignee: U.S. Philips Corporation, New York, N.Y.

[21] Appl. No.: 09/243,716

[22] Filed: Feb. 3, 1999

[30] Foreign Application Priority Data

Feb. 5, 1998 [EP] European Pat. Off. ..... 9820339

[51] Int. Cl.[6] ..... A45D 20/00

[52] U.S. Cl. ..... 34/98; 34/99; 132/271

[58] Field of Search ..... 34/96, 97, 98, 34/101; 132/271, 272, 269, 124

[56] References Cited

U.S. PATENT DOCUMENTS 5,457,894 10/1995 Dorber ..... 34/98
5,546,674 8/1996 Lange et al. ..... 34/97
5,638,608 6/1997 Dorber ..... 34/283
5,839,451 11/1998 Dorber et al. ..... 132/271
5,845,656 12/1998 Assmann ..... 132/271
5,868,148 2/1999 Lindsey et al. ..... 132/271

FOREIGN PATENT DOCUMENTS

0620713B1 10/1994 European Pat. Off. .

*Primary Examiner*—Henry Bennett
*Assistant Examiner*—Pamela A. Wilson
*Attorney, Agent, or Firm*—Ernestine C. Bartlett

[57] ABSTRACT

The invention relates to a hair drying and styling appliance for drying hair by means of hot air. The appliance comprises a hair styling unit (8) which has a convex wall portion (9) formed with a multitude of air discharge openings (10) and the surface of the convex wall portion (9) has been provided with a velvet-like or short-tufted material (14). The styling unit further has a plurality of styling pins (12) are arranged along a peripheral part (11) of the convex wall portion (9). By brushing over the hair with the velvet-like or short-tufted material of the convex wall portion, the hair becomes is given a glossy appearance.

5 Claims, 3 Drawing Sheets

HAIR DRYING AND STYLING APPLIANCE

The invention relates to a hair drying and styling appliance comprising a housing having an air inlet opening and an air outlet opening, a motor-fan unit for drawing in air via the inlet opening and discharging air via the outlet opening, a heating element which can be turned on and turned off at option for heating or not heating the air which flows through, a hair styling unit attached to the appliance and, viewed in the air flow direction, situated upstream of the outlet opening of the appliance, which hair styling unit has a convex wall portion formed with a multitude of air discharge openings and has a plurality of styling pins which extend substantially in the direction of the air which flows out.

Such an appliance is known from EP-A-620 713. The hair styling unit of this appliance has styling pins which extend from the convex wall portion between the air discharge openings in the air flow direction.

It is an object of the invention to improve the hair drying and styling appliance of the type defined in the opening paragraph in such a manner that the hair is not only given more volume but that the hair is also given a glossy appearance.

To this end the invention is characterized in that the surface of the convex wall portion has been provided with a velvet-like or short-tufted material, and the styling pins are arranged along a peripheral part of the wall portion.

The styling pins lift the hair, after which the hair is dried by the hot air from the openings in the convex wall portion and is fixed near the hair implantation, as a result of which the hair is given more volume. By brushing over the hair with the velvet-like (velvety) or short-tufted material on the convex wall part of the styling unit the hair is given a glossy appearance.

Figure 2:
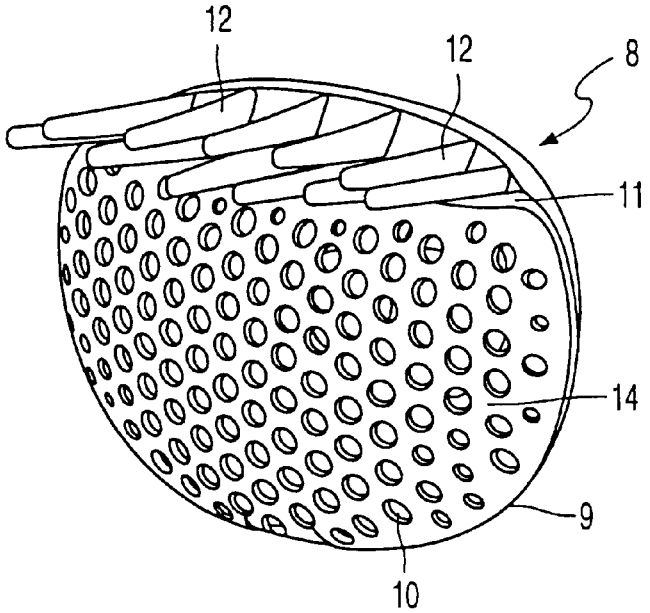
Figure 3:
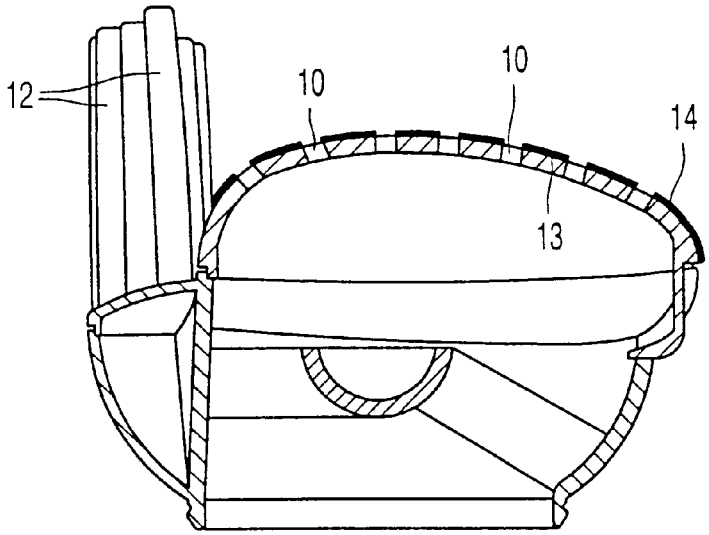
Figure 4:
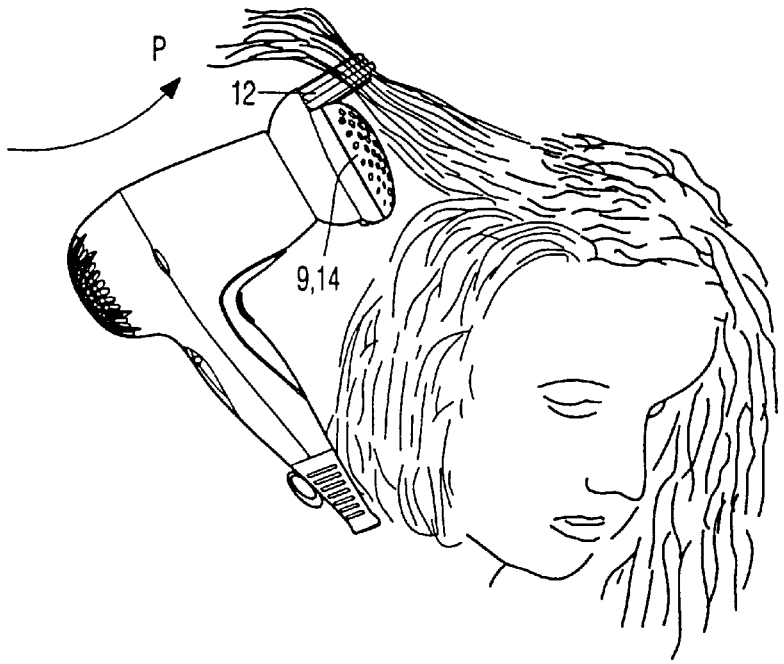
Figure 5:
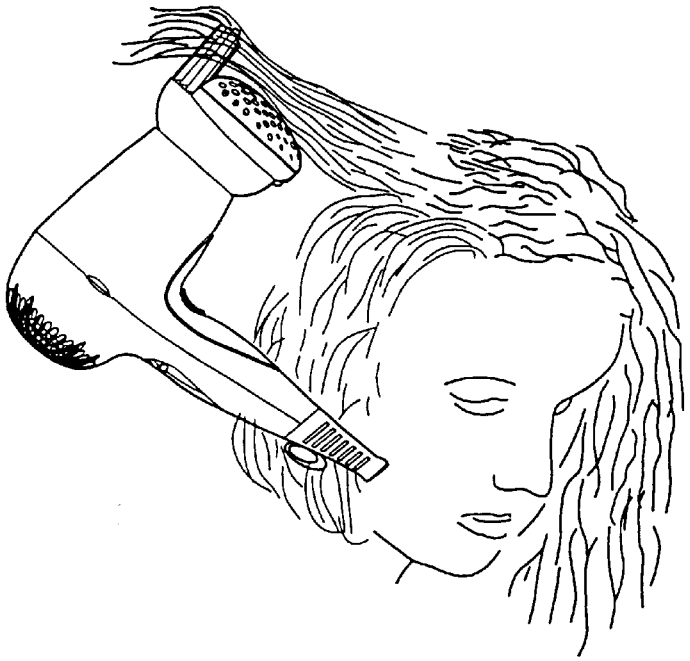

The invention will now be described in more detail with reference to an embodiment shown in the drawings. In the drawings FIG. 1 is a view of a hair drying and styling appliance, FIG. 2 is a perspective view of the hair styling unit, FIG. 3 is a cross-sectional view of the hair styling unit in FIG. 2, FIGS. 4 and 5 illustrate the manner in which the hair drying and styling appliance is used, and FIG. 6 the convex wall portion of the hair styling unit whose surface has been provided with a short-pile material.

Figure 1:
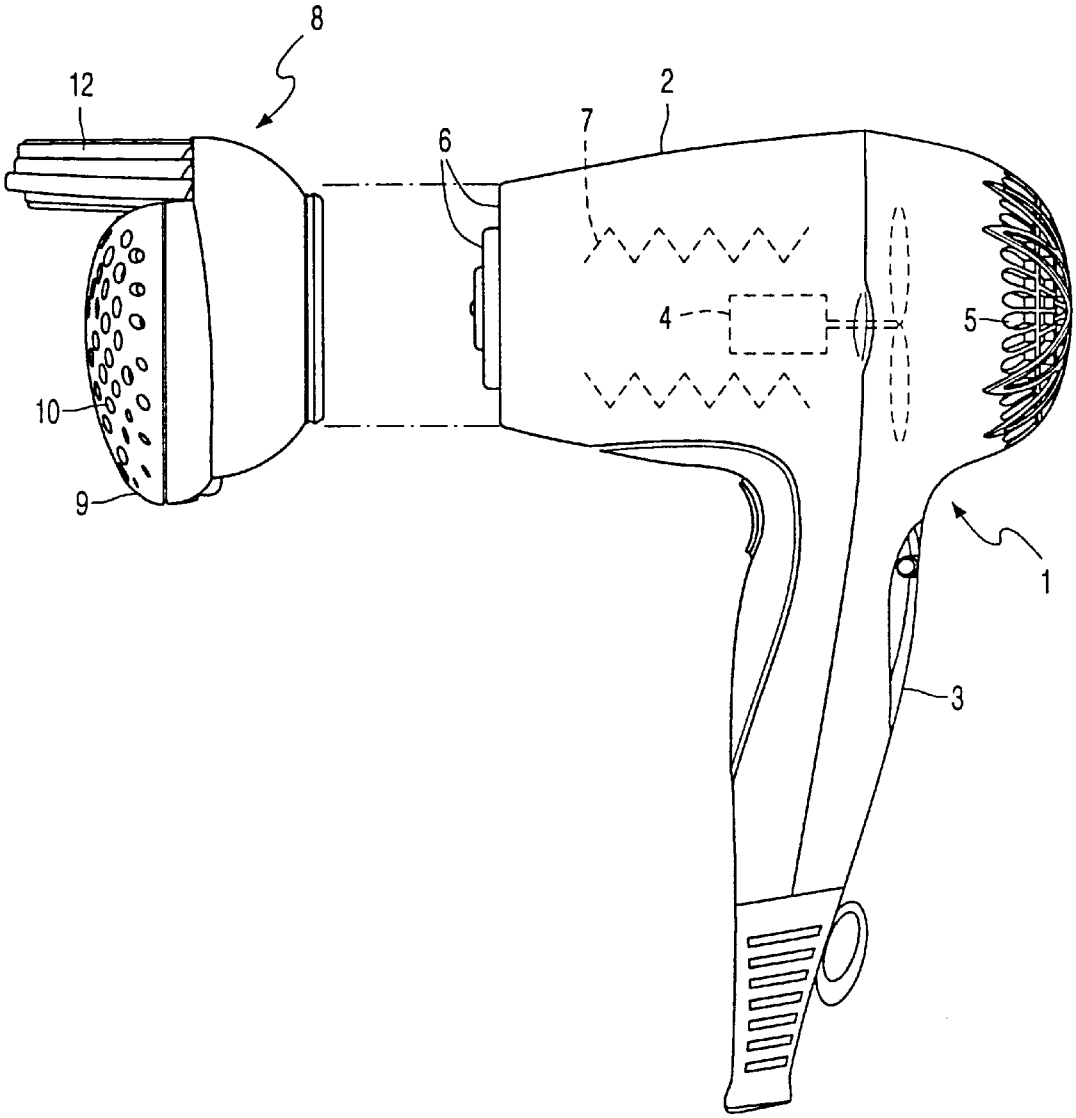

The hair drying and styling appliance shown in FIG. 1 has a housing 1 which essentially comprises a cylindrical part 2 and a handle 3, which extends substantially perpendicularly to this cylindrical part. The cylindrical part 2 accommodates a motor-fan unit 4 for taking in air via the inlet openings 5 at the rear of the cylindrical part 2 and for discharging the air via outlet openings 6 at the front of the part 2. The cylindrical part further accommodates a heating element 7 which can be turned on and turned off at option for heating or not heating the air which flows through. A hair styling unit 8 can be attached to the front of the cylindrical part 2 of the appliance near the outlet openings 6. As is shown in FIGS. 2 and 3, this hair styling unit has a convex wall portion 9 formed with a multitude of air discharge openings 10. A plurality of styling pins 12 which extend substantially in the direction of the air which flows out are arranged along a part of the periphery 11 of the convex wall portion 9. During normal use of the appliance, i.e. when the handle 3 points downward, the styling pins are situated at the top. The surface 13 of the convex wall portion 9 around the air discharge openings 10 has been provided with a velvet-like material 14 (see FIG. 3). FIG. 4 illustrates how the appliance is to be used. By making a kind of twisting movement with the appliance, as is indicated by an arrow P, the wet hairs are lifted by the styling pins 12 and are dried by the hot air, as a result of which the hairs are fixed near the hair implantation. This gives the hair more volume. By subsequently brushing over the hair with the velvet-like (velvety) material 14 of the convex wall portion, the hair is also given a glossy appearance (see FIG. 5). A reason for this glossy appearance is that the hairs are thus arranged in parallel.

Figure 6:
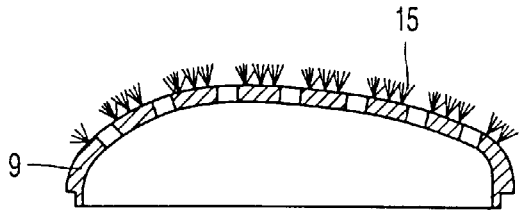

Instead of a velvet-like material it is possible to use a short-tufted material 15, as shown in FIG. 6. The convex wall portion 9 can be constructed as a detachable and exchangeable accessory of the hair styling unit. The hair styling unit itself can be integral with the housing but will generally be used as an attachment for a hair dryer, as is shown in FIG. 1.

I claim:

1. A hair drying and styling appliance comprising a housing having an air inlet opening and an air outlet opening, a motor-fan unit for drawing in air via the inlet opening and discharging air via the outlet opening, a heating element which can be turned on and turned off to heat the air which flows through, a hair styling unit attached to the appliance and situated upstream of the outlet opening of the appliance, which hair styling unit has a convex wall portion formed with a multitude of air discharge openings and has a plurality of styling pins which extend substantially in the direction of the air which flows out, wherein the surface of the convex wall portion has been provided with a material selected from the group consisting of velvety and short-tufted material, and the styling pins are arranged along a peripheral part of the wall portion.

2. A hair drying and styling appliance as claimed in claim 1, wherein the hair styling unit is an attachment which is detachable from the appliance.

3. A convex wall portion for use in the hair styling unit as claimed in claim 1, wherein the surface of the convex wall portion has been provided with a velvety or short-tufted material.

4. A hair styling unit having a convex wall portion formed with a multitude of air discharge openings and having a plurality of styling pins which extend substantially in the direction of the air which flows out, wherein the surface of the convex wall portion has been provided with a material selected from the group consisting of velvety and short-tufted material, and the styling pins are arranged along a peripheral part of the wall portion.

5. A convex wall portion for use in the hair styling unit as claimed in claim 4, wherein the surface of the convex wall portion has been provided with a velvety or short-tufted material.

* * * * *